US009951937B2

(12) United States Patent
Chen

(10) Patent No.: US 9,951,937 B2
(45) Date of Patent: Apr. 24, 2018

(54) LIGHTING DEVICE AND LIGHTING DEVICE ASSEMBLING AND DISASSEMBLING METHOD COMPLYING WITH SAFETY REGULATIONS

(71) Applicant: LivingStyle Enterprises Limited, Guang Dong Province (CN)

(72) Inventor: Ming-Yun Chen, Guang Dong Province (CN)

(73) Assignee: LIVINGSTYLE ENTERPRISES LIMITED, Dong Guan (CN)

( * ) Notice: Subject to any disclaimer, the term of this patent is extended or adjusted under 35 U.S.C. 154(b) by 743 days.

(21) Appl. No.: 14/448,114

(22) Filed: Jul. 31, 2014

(65) Prior Publication Data

US 2015/0036359 A1 Feb. 5, 2015

(30) Foreign Application Priority Data

Jul. 31, 2013 (CN) ..... 2013 1 0328830

(51) Int. Cl.

| | |
|---|---|
| ***F21V 23/06*** | (2006.01) |
| ***F21V 23/04*** | (2006.01) |
| ***F21S 8/00*** | (2006.01) |
| ***F21V 23/00*** | (2015.01) |
| *F21W 131/10* | (2006.01) |
| *H01R 13/621* | (2006.01) |

(52) U.S. Cl.

CPC ..... *F21V 23/06* (2013.01); *F21S 8/033* (2013.01); *F21V 23/006* (2013.01); *F21V 23/0471* (2013.01); *F21W 2131/10* (2013.01); *H01R 13/621* (2013.01); *Y10T 29/49117* (2015.01)

(58) Field of Classification Search

CPC ..... F21V 23/06; F21V 23/006; F21V 23/008; F21V 15/01; F21V 17/101; Y10T 29/53252; Y10T 29/53274

USPC ..... 362/368, 650, 659, 647, 657

See application file for complete search history.

(56) References Cited

U.S. PATENT DOCUMENTS

| | | | | |
|---|---|---|---|---|
| 5,537,304 A * | 7/1996 | Klaus | F21S 8/04 | 362/147 |
| 6,120,165 A * | 9/2000 | Shalvi | F21S 8/081 | 315/149 |
| 8,657,474 B2 * | 2/2014 | Breen, IV | H01R 33/46 | 362/365 |

* cited by examiner

*Primary Examiner* — Jong-Suk (James) Lee
*Assistant Examiner* — Mark Tsidulko
(74) *Attorney, Agent, or Firm* — WPAT, PC

(57) ABSTRACT

A lighting device and a lighting device assembling and disassembling method complying with safety regulations are provided. The lighting device includes a main body, a circuit module, a fixing module, and a backside plate. The backside plate includes a first electric connection slot corresponding to the fixing module and a second electric connection slot corresponding to a first electric connection part of the circuit module. In the assembling process, the fixing module is initially connected with the first electric connection slot, and the electric connection between these two components is established. While the fixing module is connected with the first electric connection slot, the electric connection between the first electric connection part and the second electric connection slot is established. Afterwards, the fixing module and the first electric connection slot are structurally connected with each other.

17 Claims, 11 Drawing Sheets

LIGHTING DEVICE AND LIGHTING DEVICE ASSEMBLING AND DISASSEMBLING METHOD COMPLYING WITH SAFETY REGULATIONS

FIELD OF THE INVENTION

The present invention relates to a lighting device, and more particularly to a lighting device that is easily assembled and disassembled and a lighting device assembling and disassembling method that complies with safety regulations.

BACKGROUND OF THE INVENTION

Conventionally, a lighting device comprises a main body, a light source, and a lamp cover. The light source is disposed within the main body or connected with the main body for emitting a light beam. The lamp cover is located in front of the light source for protecting the light source. After the lighting device is turned on, the light source is powered to output the light beam. The light beam is transmitted through the lamp cover and outputted to the outside of the lighting device. Generally, the lighting device is installed on an installation surface such as a wall surface or a ceiling surface. In addition, a power cable is disposed on the installation surface so as to be connected with a power source.

For installing the lighting device on the installation surface, the power cable on the installation surface and circuit module within the main body have to be firstly connected with each other by the worker. After the worker confirms that the light source acquires the electric power from the power source, the main body may be fixed on the installation surface. The electric connection between the power cable and the circuit module should comply with safety regulations.

The safety regulations comprise the safety regulations of the assembling process and the safety regulations of the disassembling process. According to the safety regulations of the assembling process, after the earth wire of the circuit module and the power cable are connected with each other, the live wire of the circuit module and the power cable are connected with each other and the neutral wire of the circuit module and the power cable are connected with each other. According to the safety regulations of the disassembling process, after the live wire and the neutral wire are detached from the power cable, the earth wire is detached from the power cable.

From the above discussions, the assembling process and the disassembling process of the lighting device should comply with safety regulations. In other words, the assembling process and the disassembling process of the lighting device are very complicated.

Therefore, there is a need of providing a lighting device that is easily assembled and disassembled and complies with safety regulations in order to overcome the above drawbacks.

SUMMARY OF THE INVENTION

An object of the present invention provides a lighting device that is easily assembled and disassembled and complies with safety regulations in order to overcome the drawbacks of the conventional technology.

Another object of the present invention provides a lighting device assembling and disassembling method that is simple and complies with safety regulations in order to overcome the drawbacks of the conventional technology.

In accordance with an aspect of the present invention, there is provided a lighting device. The lighting device includes a lamp, a main body, a circuit module, a fixing module, and a backside plate. The lamp emits a light beam. The main body is connected with the lamp, and includes a first opening and a receiving sleeve. The circuit module is disposed within the main body, and includes a first electric connection part. The fixing module is partially penetrated through the first opening and disposed within the receiving sleeve. The circuit board is fixed within main body by the fixing module. The backside plate is electrically connected with a power source. When the backside plate is connected with the main body, the backside plate is electrically connected with the fixing module and the first electric connection part so as to provide an electric power to the circuit module. The backside plate includes a first electric connection slot corresponding to the fixing module and a second electric connection slot corresponding to the first electric connection part. The first electric connection slot is electrically connected with the power source. When the fixing module is inserted into the first electric connection slot, an electric connection between the fixing module and the first electric connection slot is established. The second electric connection slot is electrically connected with the power source. When the first electric connection part is inserted into the second electric connection slot, an electric connection between the first electric connection part and the second electric connection slot is established.

In an embodiment, during a process of assembling the main body with the backside plate, the fixing module is initially connected with the first electric connection slot, so that the electric connection between the fixing module and the first electric connection slot is established. After the first electric connection part is connected with the second electric connection slot, the fixing module is completely connected with the first electric connection slot. During a process of disassembling the main body from the backside plate, the fixing module is initially detached from the first electric connection slot. After the first electric connection part is detached from the second electric connection slot, the fixing module is completely detached from the first electric connection slot.

In an embodiment, the circuit module further includes a second electric connection part, the second electric connection part is located beside the first electric connection part, the backside plate further includes a third electric connection slot corresponding to the second electric connection part, and the third electric connection slot is electrically connected with the power source. When the second electric connection part is inserted into the third electric connection slot, an electric connection between the second electric connection part and the third electric connection slot is established. The fixing module is an earth wire, the first electric connection part is a live wire, and the second electric connection part is a neutral wire. Alternatively, during a process of assembling the main body with the backside plate, the fixing module is initially connected with the first electric connection slot, so that the electric connection between the fixing module and the first electric connection slot is established. After the first electric connection part and the second electric connection part are connected with the second electric connection slot and the third electric connection slot, respectively, the fixing module is completely connected with the first electric connection slot. During a process of disassembling the main body from the backside plate, the fixing module is initially detached from the first electric connection slot. After the first electric connection part and the second electric connection part are detached from the second electric connection slot and the third electric connection slot, respectively, the fixing module is completely detached from the first electric connection slot.

In an embodiment, the fixing module includes a fixing post and a pushing element. The fixing post is penetrated through the first opening. The fixing post includes a locking part, a first segment, and a second segment. The locking part is located at a first end of the fixing post. The locking part is stopped by the main body, so that the locking part is not inserted into the first opening. The first segment is located at a second end of the fixing post. The first segment is inserted into the receiving sleeve and connected with the backside plate. The first segment has a first diameter. The second segment is arranged between the locking part and the first segment and inserted into the receiving sleeve. The second segment has a second diameter, and the second diameter is larger than the first diameter. The pushing element is sheathed around the fixing post through a first end of the fixing post and disposed within the receiving sleeve. The circuit module is fixed in the main body by the pushing element. When the first segment is contacted with the backside plate, the fixing post is initially connected with the backside plate, so that the electric connection between the fixing post and the backside plate is established. When the backside plate is contacted with the pushing element, the fixing post is completely connected with the backside plate. When the fixing post is moved toward the main body and the pushing element is not contacted with the backside plate, the fixing post is initially detached from the backside plate. When the fixing post is moved toward the main body and the fixing post is not contacted with the backside plate, the fixing post is completely detached from the backside plate.

In an embodiment, the fixing module further includes a fixing glue, and the fixing glue is arranged between the first segment and the second segment. The pushing element is fixed between the first segment and the second segment via the fixing glue, so that the pushing element and the fixing post are synchronously rotated and moved with each other. When the fixing post is moved toward the main body, the main body is pushed by the pushing element, so that the first electric connection part of the circuit module within the main body is detached from the backside plate.

In an embodiment, the locking part, the first segment and the second segment are integrally formed with the fixing post, the fixing post is a screw, the first segment has plural threads distributed over a surface of the first segment, and the pushing element is a nut.

In an embodiment, the main body further includes a first case and a second case. The first opening runs through a first surface and a second surface of the first case. The second case is connected with the first case, and includes a first covering part and a second covering part. The first covering part is connected with the first case and contacted with the second surface of the first case. The first covering part includes a second opening. The second opening runs through a first surface and a second surface of the first covering part. The receiving sleeve is disposed on the second surface of the first covering part. The receiving sleeve is arranged around the second opening. The second covering part is connected with the first case and fixed on the first covering part. The second covering part includes a third opening. The third opening runs through a first surface and a second surface of the second covering part. An accommodation space is defined by the first covering part and the second covering part collaboratively. The circuit module is accommodated within the accommodation space. The first case is made of a metallic material and the second case is made of a plastic material. Alternatively, the first covering part is integrally formed with the first case.

In an embodiment, the second covering part further includes a fourth opening. The fourth opening is located beside the third opening. The circuit module includes a circuit board and plural electronic components. The circuit board includes a circuit board perforation. The receiving sleeve is penetrated through the circuit board perforation and the third openings. The plural electronic components are disposed on a first surface of the circuit board. The first electric connection part is disposed on a second surface of the circuit board and penetrated through the fourth opening to be electrically connected with the second electric connection slot. Alternatively, the fixing module is an earth wire and the first electric connection part is a live wire.

In an embodiment, the lighting device further includes a human sensing module, and the human sensing module detects whether any human body is located within a sensing range. If the human sensing module detects that a human body is within the sensing range, the human sensing module issues a human sensing signal. A warning function or an automatic illuminating function is enabled in response to the human sensing signal. The human sensing module includes a sensor body and a human sensor. The sensor body is connected with the main body. The human sensor is disposed within the sensor body and detects whether any human body is located within a sensing range. If the human sensor detects that a human body is within the sensing range, the human sensor generates the human sensing signal in order to provide the warning function or the automatic illuminating function. The human sensor includes at least one of a passive infrared sensor and a microwave sensor. Alternatively, the lamp includes a lamp body and a light-emitting element. The lamp body is connected with the main body. The light-emitting element is disposed within the lamp body and emits the light beam. The lighting device is an outdoor lighting device, and the light-emitting element includes at least one light emitting diode unit.

In accordance with another aspect of the present invention, there is provided a lighting device assembling and disassembling method complying with safety regulations. The lighting device assembling and disassembling method includes an assembling process of a lighting device, and a disassembling process of the lighting device. The assembling process includes the following steps. Firstly, a fixing post is penetrated through a main body from a first side of the main body, and a pushing element is disposed on the fixing post from a second side of the main body. Then, a circuit module is installed and fixed within the main body. Then, the fixing post is rotated in a first direction, so that the fixing post is initially connected with a first electric connection slot of a backside plate. Then, the fixing post is continuously rotated in the first direction, and a first electric connection part of the circuit module is connected with a second electric connection slot of the backside plate. Then, the fixing post is continuously rotated in the first direction, and the fixing post is completely connected with the first electric connection slot after the first electric connection part is connected with the second electric connection slot. The disassembling process includes the following steps. Firstly, the fixing post is rotated in a second direction, so that the fixing post is initially detached from the first electric connection slot, wherein the second direction is reverse to the first direction. Then, the fixing post is continuously rotated in the second direction, and the pushing element is contacted with the main body in response to rotation of the fixing post, so that the main body is detached from the backside plate. When the main body is detached from the backside plate, the first electric connection part is detached from the second electric connection slot. Then, the fixing post is continuously rotated in the second direction, and the fixing post to be completely detached from the first electric connection slot after the first electric connection part is detached from the second electric connection slot.

In an embodiment, the step of allowing the pushing element to be disposed on the fixing post from the second side of the main body includes the following sub-steps. Firstly, a first case of the main body and a first covering part of the main body are connected with each other. Then, the fixing post is penetrated through the first case and the first covering part from the first side of the main body. Then, the pushing element is disposed on the fixing post from a second side of the first covering part in a sheathing manner, a spot-welding manner or a snap-fitting manner. Then, the pushing element is rotated in a second direction and the pushing element is fixed on the fixing post, so that the pushing element is synchronously rotated and moved with the fixing post.

In an embodiment, the step of installing and fixing the circuit module within the main body includes the following sub-steps. Firstly, the circuit module is disposed within the first covering part from the second side of the first covering part, and the fixing element and the pushing element are penetrated through the circuit module. The first covering part and a second covering part of the main body are connected with each other. Then, the second covering part is fixed on the first covering part from the second side of the first covering part, and the circuit module is fixed within the first covering part and the second covering part.

In an embodiment, the step of allowing the pushing element to be disposed on the fixing post from the second side of the main body includes the following sub-steps. Firstly, a first case of the main body and a first covering part of the main body to be connected with each other. Then, the fixing post is penetrated through the first case and the first covering part from the first side of the main body. Then, the pushing element is sheathed around the fixing post from a second side of the first covering part. Then, the pushing element is rotated in the second direction and the pushing element is fixed on the fixing post. Then, a fixing glue is attached between the fixing post and the pushing element, wherein the pushing element is fixed on the fixing post via the fixing glue, so that the pushing element is synchronously rotated and moved with the fixing post.

In an embodiment, the step of installing and fixing the circuit module within the main body includes the following sub-steps. Firstly, the circuit module is disposed within the first covering part from the second side of the first covering part, and the fixing element and the pushing element are penetrated through the circuit module. Then, a second covering part of the main body is fixed on the first covering part from the second side of the first covering part, and fixing the circuit module within the first covering part and the second covering part.

In an embodiment, when the fixing post is rotated in the first direction, the fixing post is moved in a direction toward the second side of the main body and the main body is pushed by the fixing post to be close to the backside plate. When the fixing post is rotated in the second direction, the fixing post is moved in a direction toward the first side of the main body and the main body is pushed by the pushing element to be moved away from the backside plate. Alternatively, when the fixing post is rotated to be moved and the first electric connection part is connected with the second electric connection slot, a second electric connection part of the circuit module is connected with a third electric connection slot of the backside plate. When the fixing post is rotated and the main body is pushed by the pushing element, the first electric connection part is detached from the second electric connection slot and the second electric connection part is detached from the third electric connection slot.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For obviating the drawbacks of the conventional technology, the present invention provides an improved lighting device.

Figure 1:
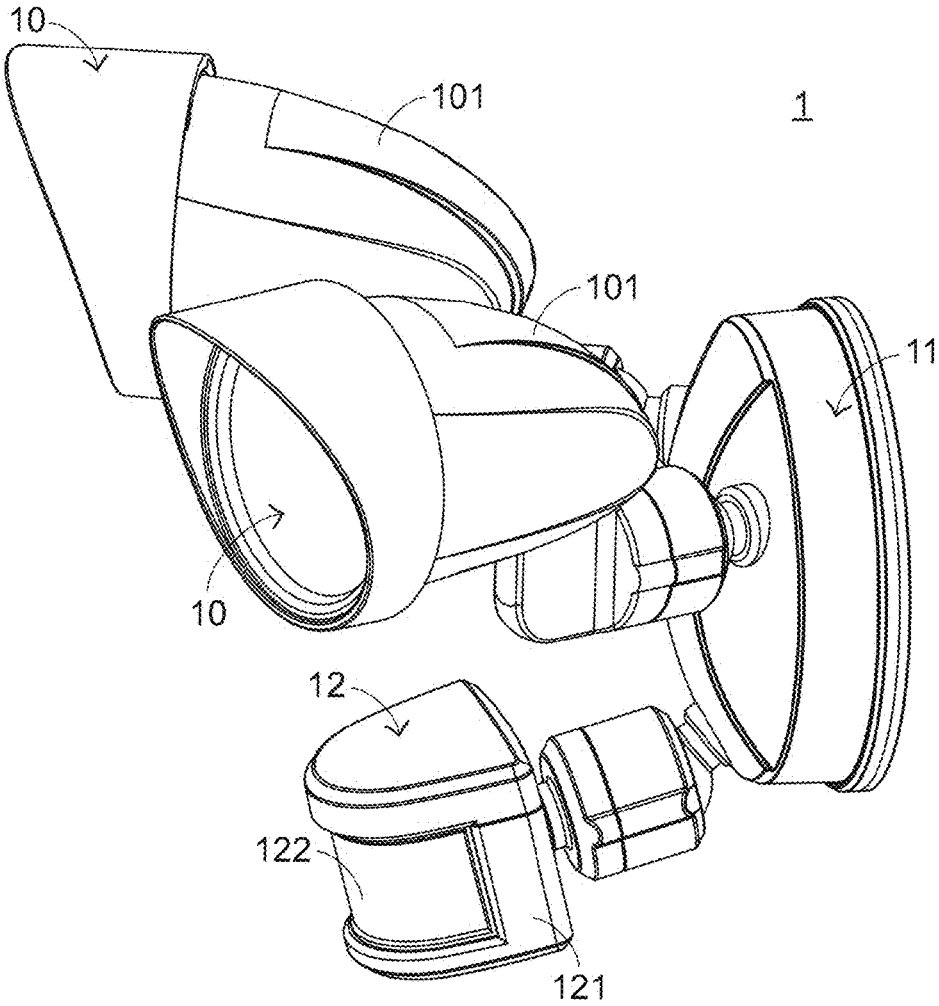
FIG. 1 is a schematic perspective view illustrating the outer appearance of a lighting device according to an embodiment of the present invention.
Figure 2:
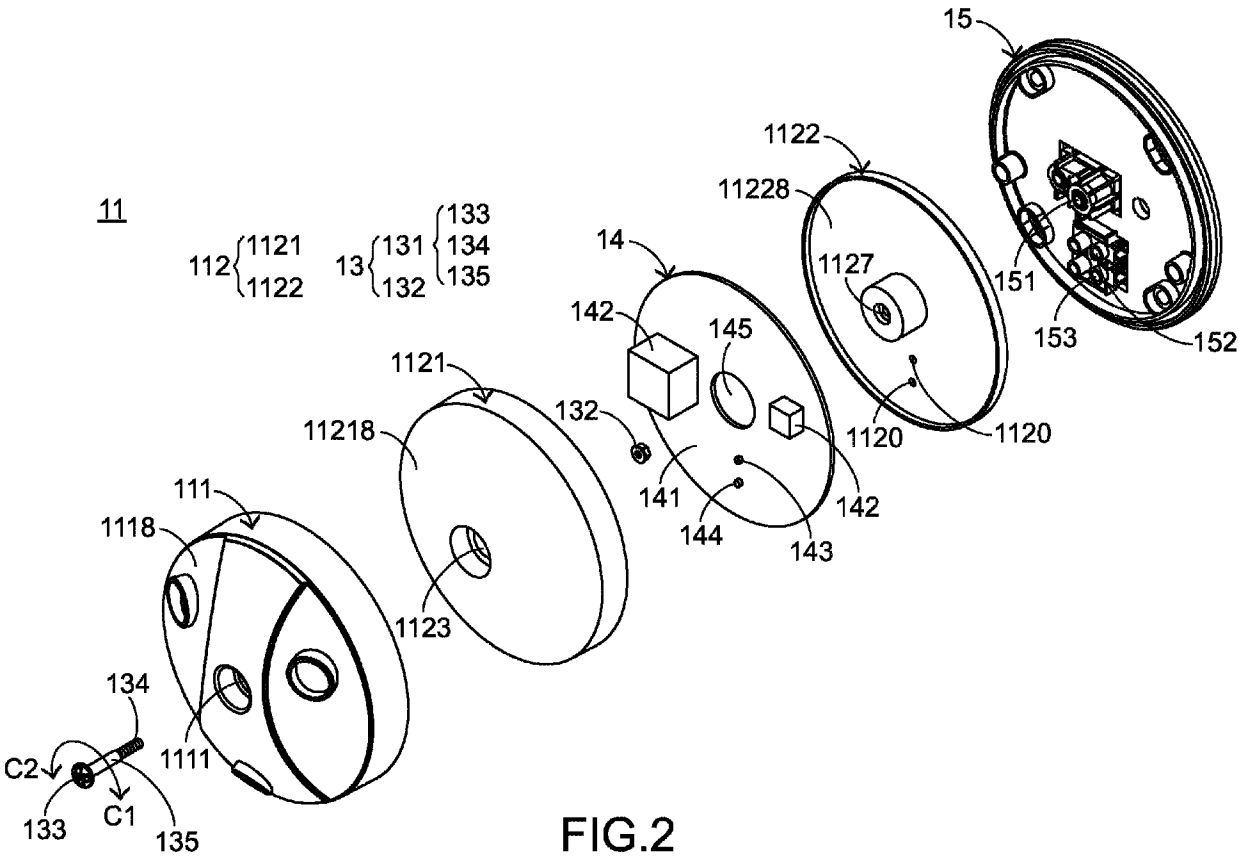
FIG. 2 is a schematic exploded view illustrating a main body of the lighting device according to the embodiment of the present invention.
Figure 3:
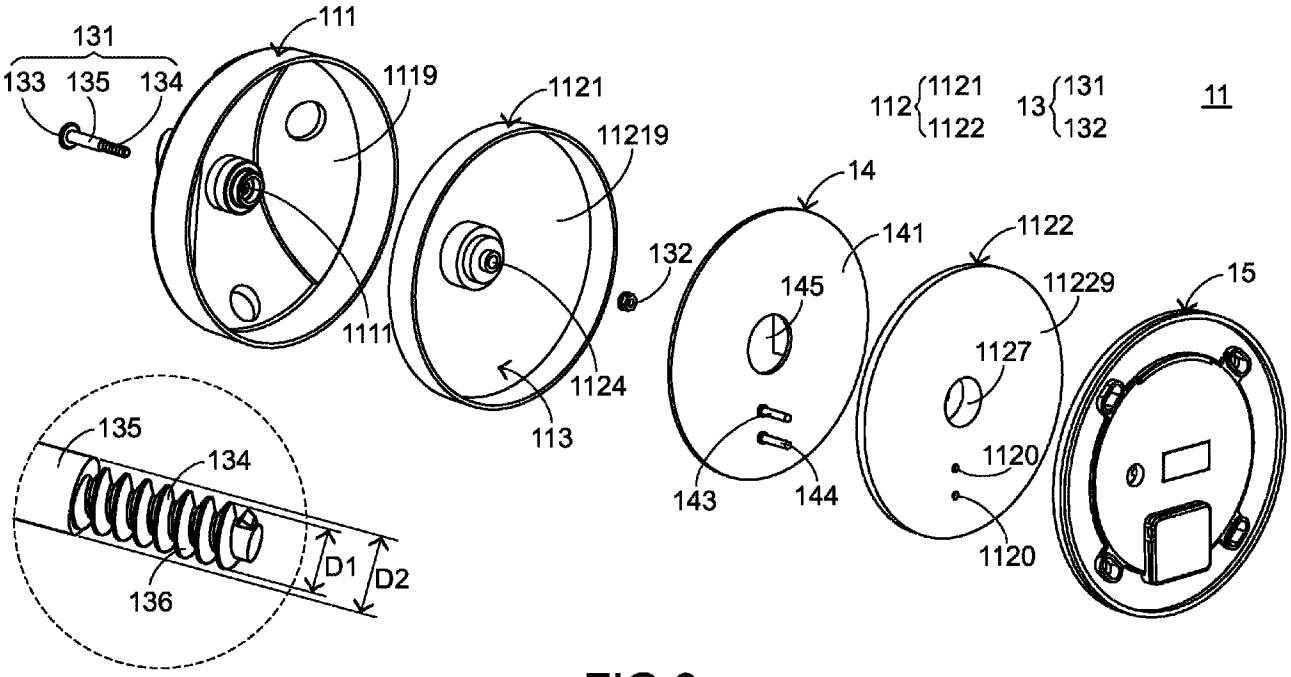
FIG. 3 is a schematic exploded view illustrating the main body of the lighting device of FIG. 2 and taken along another viewpoint.

Please refer to FIGS. 1, 2, and 3. FIG. 1 is a schematic perspective view illustrating the outer appearance of a lighting device according to an embodiment of the present invention. FIG. 2 is a schematic exploded view illustrating a main body of the lighting device according to the embodiment of the present invention. FIG. 3 is a schematic exploded view illustrating the main body of the lighting device of FIG. 2 and taken along another viewpoint. The lighting device 1 comprises plural lamps 10, a main body 11, a human sensing module 12, a fixing module 13, a circuit module 14, and a backside plate 15. For clarification and brevity, only two lamps 10 are shown in the drawings. The plural lamps 10 are rotatably connected with the main body 11. Each of the lamps 10 is used for emitting a light beam. Moreover, each lamp 10 comprises a lamp body 101 and a light-emitting element (not shown). The lamp body 101 is connected with the main body 11 and rotatable relative to the main body 11. The light-emitting element is disposed within the lamp body 101 for emitting the light beam. In this embodiment, the lighting device 1 is an outdoor lighting device, and the light-emitting element comprises at least one light emitting diode unit.

The human sensing module 12 is rotatably connected with the main body 11 for detecting whether any human body is located within a sensing range. If the human sensing module 12 detects that a human body is within the sensing range, the human sensing module 12 generates a human sensing signal. In response to the human sensing signal, a warning function is enabled. The human sensing module 12 comprises a sensor body 121 and a human sensor 122. The sensor body 121 is connected with the main body 11, and rotatable relative to the main body 11. The human sensor 122 is disposed within the sensor body 121 for detecting whether any human body is located within the sensing range. If the human sensor 122 detects that a human body is within the sensing range, the human sensor 122 generates the human sensing signal in order to provide the warning function. In an embodiment, the human sensor 122 comprises at least one of a passive infrared sensor (also referred as a PIR sensor) and a microwave sensor, but is not limited thereto. In another embodiment, the human sensing module further comprises a camera module. The camera module is disposed on the sensor body of the human sensing module. If the human sensing module detects that a human body is within the sensing range, the camera module is enabled to record images. Consequently, a surveillance monitoring function is provided, and the power consumption and the size of the stored image files are both reduced.

The main body 11 comprises a first case 111 and a second case 112. The second case 112 is covered by the first case 111. In addition, the first case 111 is connected with the backside plate 15. In this embodiment, the first case 111 has a first opening 1111. The first opening 1111 is located at a middle region of the first case 111. Moreover, the first opening 1111 runs through an outer surface 1118 and an inner surface 1119 of the first case 111. Consequently, the fixing module 13 is partially penetrated through the first opening 1111 and inserted into the first case 111. The second case 112 is connected with the first case 111. In addition, the second case 112 comprises a first covering part 1121 and a second covering part 1122. The first covering part 1121 is connected with the first case 111 and contacted with the inner surface 1119 of the first case 111. The first covering part 1121 comprises a second opening 1123 and a receiving sleeve 1124. The second opening 1123 runs through an outer surface 11218 and an inner surface 11219 of the first covering part 1121. The receiving sleeve 1124 is disposed on the inner surface 11219 of the first covering part 1121. Moreover, the receiving sleeve 1124 is arranged around the second opening 1123.

The second covering part 1122 of the second case 112 is connected with the first case 111, and fixed on the first covering part 1121. Moreover, an accommodation space 113 is defined by the first covering part 1121 and the second covering part 1122 collaboratively. Consequently, the circuit module 14 is accommodated within the accommodation space 113. The second covering part 1122 comprises a third opening 1127 and plural fourth openings 1120. The third opening 1127 runs through an outer surface 11228 and an inner surface 11229 of the second covering part 1122. The plural fourth openings 1120 also run through the outer surface 11228 and the inner surface 11229 of the second covering part 1122. Moreover, the plural fourth openings 1120 are located at a side of the third opening 1127. In this embodiment, the first case 111 is made of a metallic material, the second case 112 is made of a plastic material, and the receiving sleeve 1124 is integrally formed with the first covering part 1121. In another embodiment, the first covering part is integrally formed with the first case.

Please refer to FIGS. 2 and 3 again. By the fixing module 13, the circuit module 14 is fixed within the second case 112 of the main body 11. The fixing module 13 comprises a fixing post 131 and a pushing element 132. The fixing post 131 is penetrated through the first opening 1111. In this embodiment, the fixing post 131 comprises a locking part 133, a first segment 134, and a second segment 135. The pushing element 132 is fixed on the fixing post 131 through a first end of the fixing post 131. Moreover, the pushing element 132 is disposed within the receiving sleeve 1124 for fixing the circuit module 14 within the main body 11. In the fixing post 131, the locking part 133 is located at the first end of the fixing post 131. Since the locking part 133 is stopped by the main body 11, the locking part 133 is not inserted into the first opening 1111. The first segment 134 is located at a second end of the fixing post 131. The first segment 134 is inserted into the receiving sleeve 1124 and connected with the backside plate 15. Moreover, the first segment 134 has a first diameter D1. The second segment 135 is arranged between the locking part 133 and the first segment 134. The second segment 135 is inserted into the receiving sleeve 1124. Moreover, the second segment 135 has a second diameter D2. The second diameter D2 is larger than the first diameter D1.

In this embodiment, the locking part 133, the first segment 134 and the second segment 135 are integrally formed with the fixing post 131. Moreover, the fixing post 131 is a screw, the first segment 134 has plural threads 136 distributed over the surface of the first segment 134, and the pushing element 132 is a nut. The pushing element 132 is engaged with the plural threads 136 of the first segment 134, so that the pushing element 132 is fixed between the first segment 134 and the second segment 135. Under this circumstance, the pushing element 132 is synchronously rotated and moved with the fixing post 131. In another embodiment, the fixing module 13 further comprises a fixing glue (not shown). The fixing glue is arranged between the first segment 134 and the second segment 135 for fixing the pushing element 132 between the first segment 134 and the second segment 135 in order to facilitate connection between the pushing element 132 and the fixing post 131. Consequently, the pushing element 132 and the fixing post 131 are synchronously rotated and moved with each other.

The circuit board 14 is disposed with the accommodation space 113 of the second case 112. The circuit board 14 comprises a circuit board 141, plural electronic components 142, a first electric connection part 143, and a second electric connection part 144. The circuit board 141 has a circuit board perforation 145. After the circuit module 14 is accommodated within the accommodation space 113, the receiving sleeve 1124 is sequentially penetrated through the circuit board perforation 145 and the third opening 1127. The plural electronic components 142 are disposed on a first surface of the circuit board 141. The first electric connection part 143 is disposed on a second surface of the circuit board 141. The second electric connection part 144 is disposed on the second surface of the circuit board 141, and located beside the first electric connection part 143. In this embodiment, the fixing post 131 of the fixing module 13 is an earth wire, the first electric connection part 143 is a live wire, and the second electric connection part 144 is a neutral wire. The examples of these components are not restricted. In an embodiment, the circuit module is equipped with the first electric connection part (i.e. the live wire), but the circuit module is not equipped with the second electric connection part (i.e. the neutral wire).

The backside plate 15 is connected with a power source (not shown). When the backside plate 15 is connected with the main body 11, the backside plate 15 is electrically connected with the fixing post 131 of the fixing module 13, the first electric connection part 143 and the second electric connection part 144 so as to provide an electric power to the circuit module 14. In this embodiment, the backside plate 15 comprises a first electric connection slot 151, a second electric connection slot 152, and a third electric connection slot 153. The first electric connection slot 151 is located at a middle region of the backside plate 15 and electrically connected with the power source. The first electric connection slot 151 is aligned with the fixing post 131. Consequently, after the fixing post 131 is inserted into the first electric connection slot 151, the electric connection between the fixing module 13 and the first electric connection slot 151 is established. The second electric connection slot 152 is located at a side of the backside plate 15 and electrically connected with the power source. The second electric connection slot 152 is aligned with the first electric connection part 143. After the first electric connection part 143 is inserted into the second electric connection slot 152, the electric connection between the first electric connection part 143 and the second electric connection slot 152 is established. The third electric connection slot 153 is located at a side of the backside plate 15 and arrange beside the second electric connection slot 152. Moreover, the third electric connection slot 153 electrically connected with the power source and aligned with the second electric connection part 144. After the second electric connection part 144 is inserted into the third electric connection slot 153, the electric connection between the second electric connection part 144 and the third electric connection slot 153 is established.

Figure 4:
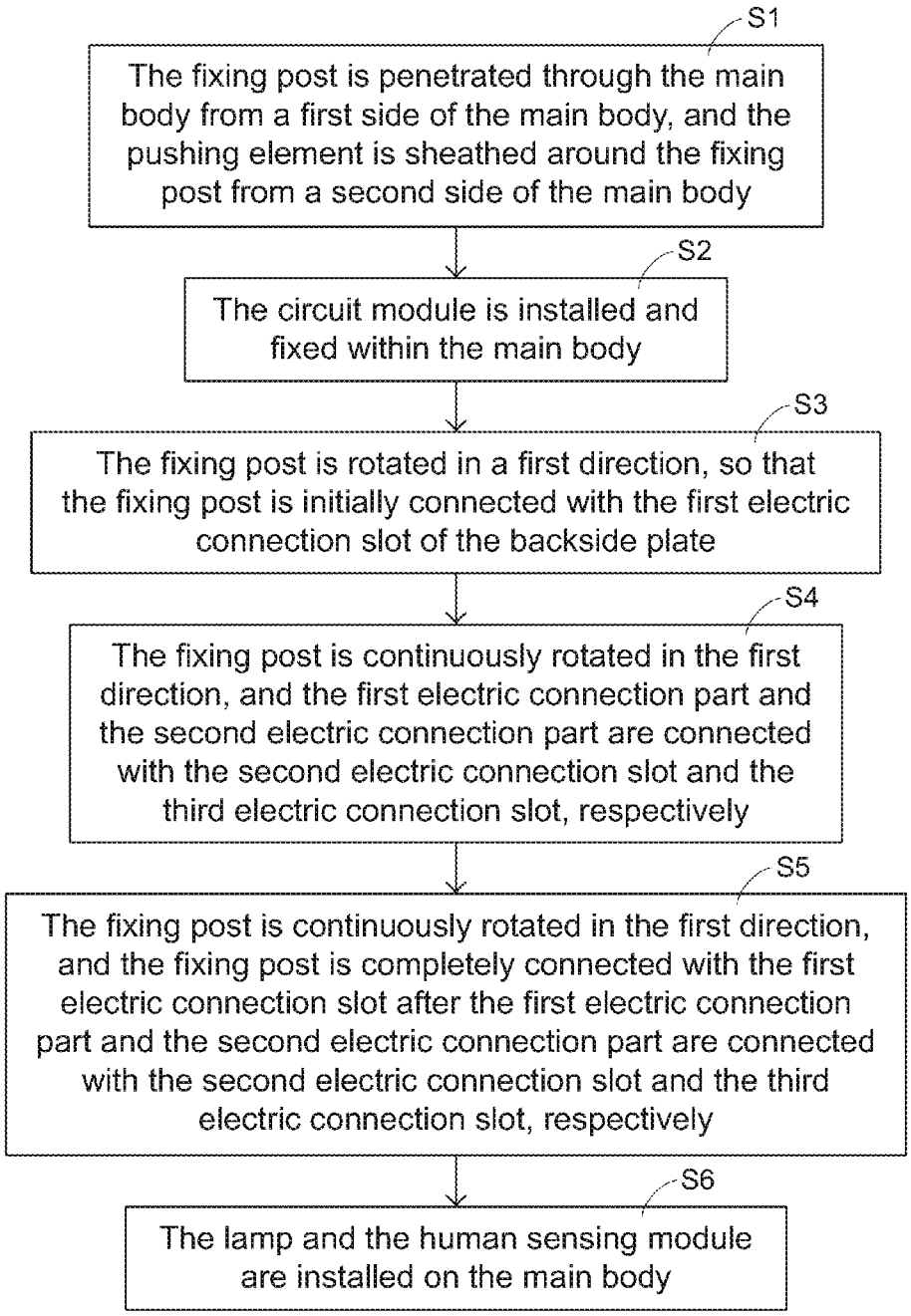
FIG. 4 is a flowchart illustrating a lighting device assembling process complying with safety regulations according to an embodiment of the present invention.

An assembling process of the lighting device will be illustrated as follows. FIG. 4 is a flowchart illustrating a lighting device assembling process complying with safety regulations according to an embodiment of the present invention. The lighting device assembling process comprises the following steps S1~S6.

In the step S1, the fixing post 131 is penetrated through the main body 11 from a first side of the main body 11, and the pushing element 132 is sheathed around the fixing post 131 from a second side of the main body 11. In the step S2, the circuit module 11 is installed and fixed within the main body 11. In the step S3, the fixing post 131 is rotated in a first direction C1, so that the fixing post 131 is initially connected with the first electric connection slot 151 of the backside plate 15. In the step S4, the fixing post 131 is continuously rotated in the first direction C1, and the first electric connection part 143 and the second electric connection part 144 are connected with the second electric connection slot 152 and the third electric connection slot 153, respectively. In the step S5, the fixing post 131 is continuously rotated in the first direction C1, and the fixing post 131 is completely connected with the first electric connection slot 151 after the first electric connection part 143 and the second electric connection part 144 are connected with the second electric connection slot 152 and the third electric connection slot 153, respectively. In the step S6, the lamp 10 and the human sensing module 12 are installed on the main body 11.

Figure 5:
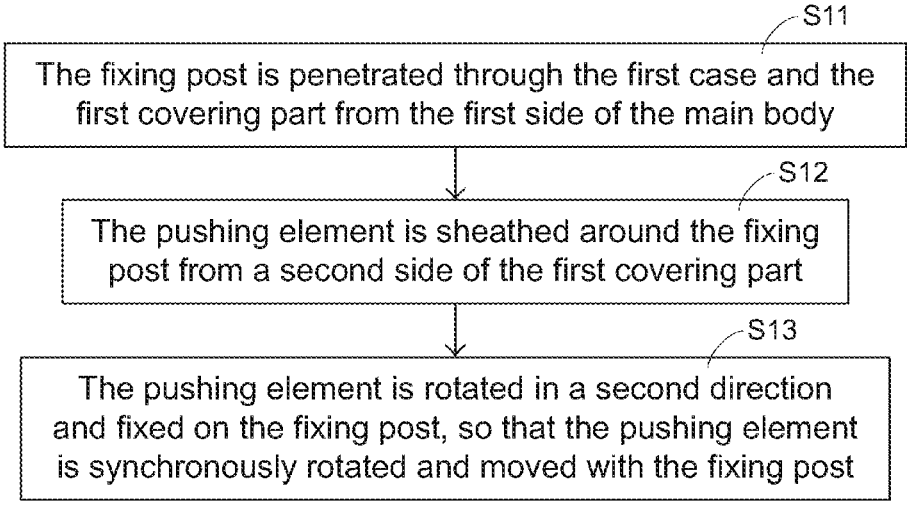
FIG. 5 is a flowchart illustrating the step of fixing the pushing element on the fixing post in the lighting device assembling process according to an embodiment of the present invention.

FIG. 5 is a flowchart illustrating the step of fixing the pushing element on the fixing post in the lighting device assembling process according to an embodiment of the present invention. The step S1 comprises the following sub-steps S11~S13. In the sub-step S11, the fixing post 131 is penetrated through the first case 111 and the first covering part 1121 from the first side of the main body 11. In the sub-step S12, the pushing element 132 is sheathed around the fixing post 131 from a second side of the first covering part 1121. In the sub-step S13, the pushing element 132 is rotated in a second direction C2 and fixed on the fixing post 131, so that the pushing element 132 is synchronously rotated and moved with the fixing post 131. An example of the pushing element 132 includes but is not limited to a nut. In another embodiment of the sub-step S12, the pushing element is disposed on the fixing post from the second side of the first covering part in a spot-welding manner or a snap-fitting manner. In case that the pushing element is disposed on the fixing post in the spot-welding manner, the pushing element is a solder bump. Whereas, in case that the pushing element is disposed on the fixing post in the snap-fitting manner, the pushing element is a snap-fit ring (also referred as an e-ring).

Figure 6:
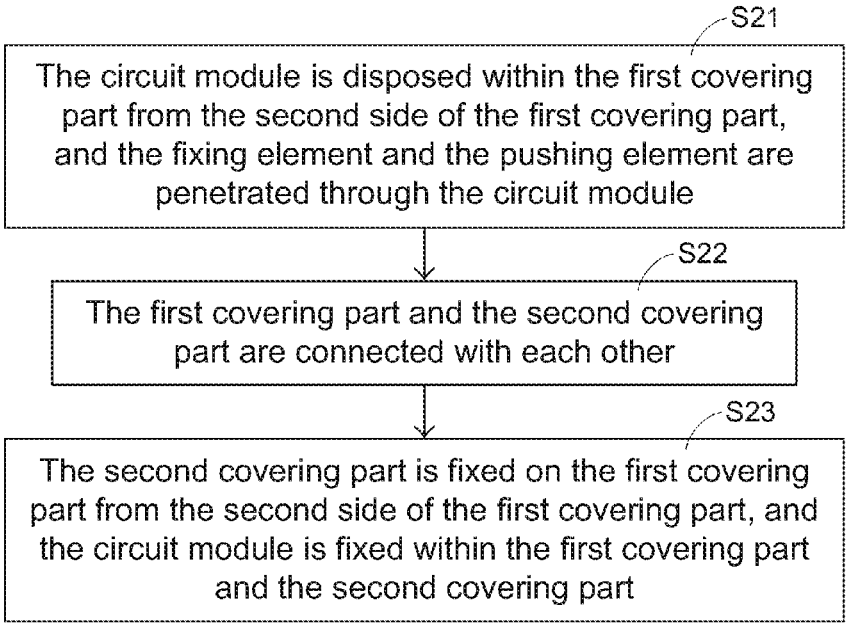
FIG. 6 is a flowchart illustrating the step of fixing the circuit module within the second case in the lighting device assembling process according to an embodiment of the present invention.

FIG. 6 is a flowchart illustrating the step of fixing the circuit module within the second case in the lighting device assembling process according to an embodiment of the present invention. The step S2 comprises the following sub-steps S21~S23. In the sub-step S21, the circuit module 14 is disposed within the first covering part 1121 from the second side of the first covering part 1121, and the fixing element 131 in the receiving sleeve 1124 and the pushing element 132 are penetrated through the circuit module 14. In the sub-step S22, the first covering part 1121 and the second covering part 1122 are connected with each other. In the sub-step S23, the second covering part 1122 is fixed on the first covering part 1121 from the second side of the first covering part 1121, and the circuit module 14 is fixed within the first covering part 1121 and the second covering part 1122. That is, in the assembling process of the lighting device 1, the circuit module 14 is fixed within the second case 112 by the sub-steps S21 and S22.

In another embodiment, after the sub-step S21, the assembling process of the lighting device 1 further comprises the following steps. That is, a fixing glue is arranged between the fixing post 131 and the pushing element 132 to strengthen the connection between the pushing element 132 and the fixing post 131, so that the pushing element 132 is synchronously rotated with the fixing post 131. In this embodiment, the first direction C1 is a clockwise direction, and the second direction C2 is a counterclockwise direction. When the fixing post 131 is rotated in the clockwise direction, the fixing post 131 is moved in a direction toward the second side of the main body 11 (i.e. in a third direction C3) and the main body 11 is pushed by the fixing post 131 to be close to the backside plate 15. On the other hand, when the fixing post 131 is rotated in the counterclockwise direction, the fixing post 131 is moved in a direction toward the first side of the main body 11 (i.e. in a fourth direction C4) and the main body 11 is pushed by the pushing element 132 to be moved away from the backside plate 15.

Figure 7:
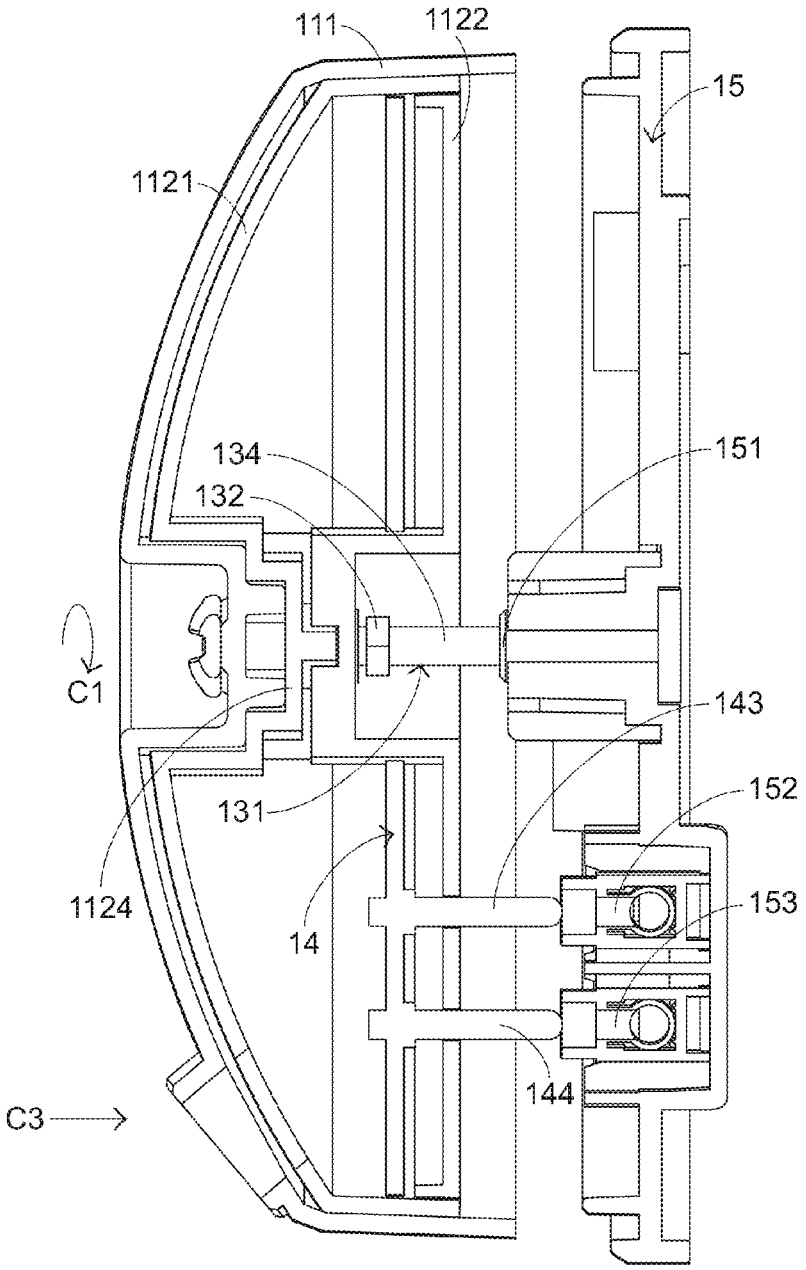
FIG. 7 is a schematic partial cross-sectional side view illustrating the initial connection between the fixing module and the first electric connection slot in the lighting device assembling process according to an embodiment of the present invention.

That is, in the steps S3, S4 and S5 of the assembling process of the lighting device 1, the first case 111, the first covering part 1121 and the fixing module 13 are moved in the third direction C3. Moreover, the fixing post 131 is penetrated through the receiving sleeve 1124, so that the first segment 134 of the fixing post 131 is initially contacted and connected with the first electric connection slot 151. Meanwhile, the electric connection between the first segment 134 and the first electric connection slot 151 is established. Under this circumstance, as shown in FIG. 7, the first electric connection part 143 is not inserted into the second electric connection slot 152, and the second electric connection part 144 is not inserted into the third electric connection slot 153.

While the fixing post 131 is rotated and screwed into the first electric connection slot 151, the second case 112 is moved toward the backside plate 15, so that the first electric connection part 143 is inserted into the second electric connection slot 152 and the second electric connection part 144 is inserted into the third electric connection slot 153. Consequently, the electric connection between the first electric connection part 143 and the second electric connection slot 152 is established, and the electric connection between the second electric connection part 144 and the third electric connection slot 153 is established. As the fixing post 131 is continuously rotated and screwed into the first electric connection slot 151, the complete connection between the fixing post 131 and the first electric connection slot 151 is implemented (see FIGS. 8 and 9).

From the above discussions about the assembling process of the lighting device 1, the earth wire is first electrically connected with the power source, and then the live wire and the neutral wire are electrically connected with the power source. Consequently, the assembling process of the lighting device 1 can comply with safety regulations.

Figure 8:
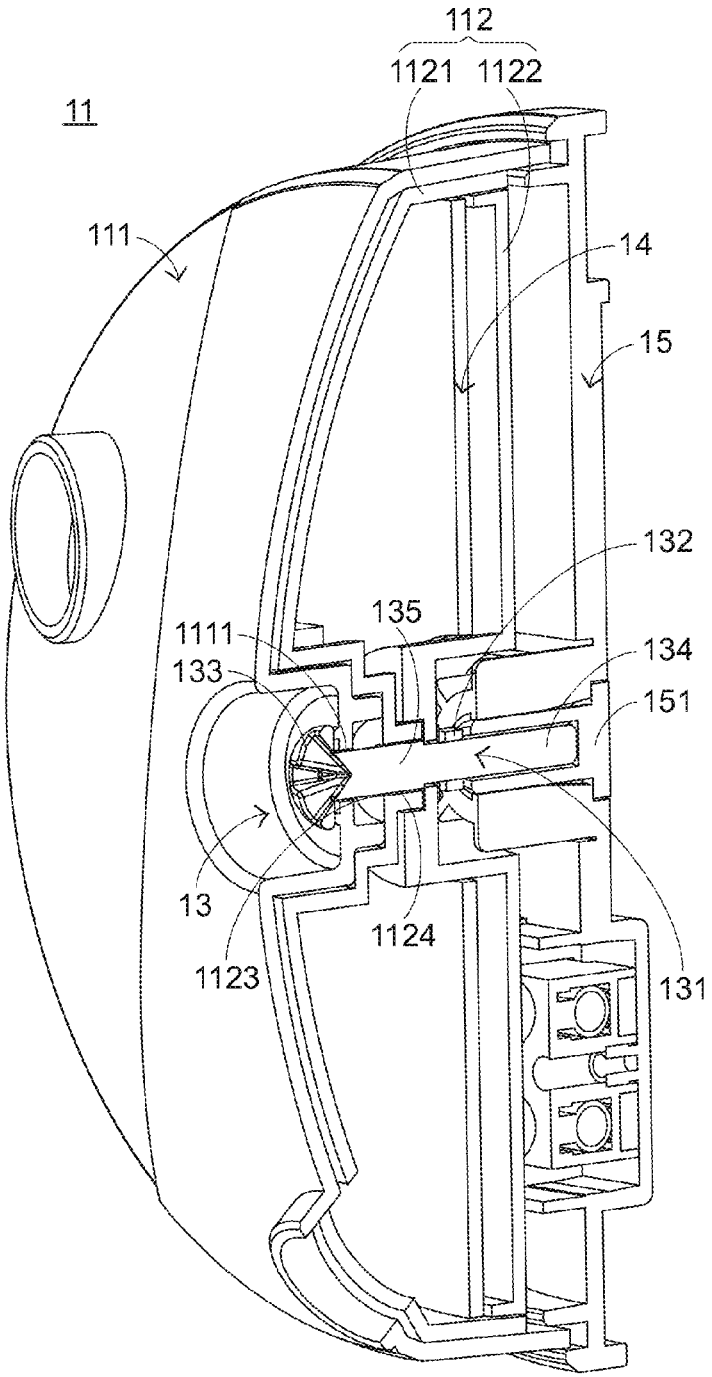
FIG. 8 is a schematic cutaway view illustrating the complete connection between the fixing module and the first electric connection slot in the lighting device assembling process according to an embodiment of the present invention.
Figure 9:
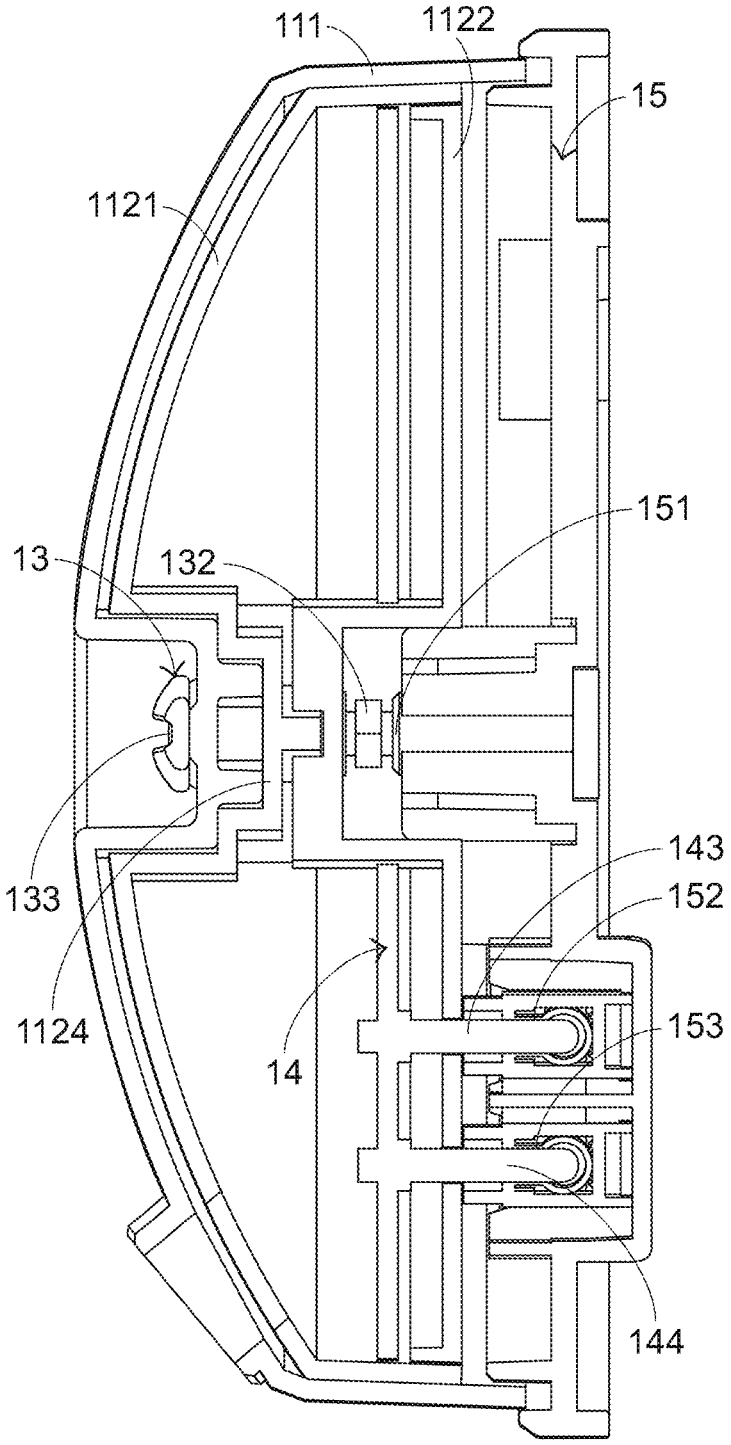
FIG. 9 is a schematic partial cross-sectional side view illustrating the connection between the fixing module, the circuit module and the backside plate in the lighting device assembling process according to an embodiment of the present invention.

After the lighting device 1 is assembled by the above assembling process, the inner structure of the main body 1 of the lighting device 1 is shown in FIGS. 8 and 9. Please refer to FIGS. 8 and 9. When the circuit module 14 is fixed in the accommodation space 113 between the first covering part 1121 and the second covering part 1122, the first electric connection part 143 and the second electric connection part 144 are penetrated through corresponding fourth openings 1120 and protruded outside the second casing 112. When the first segment 134 is contacted with the first electric connection slot 151, it means that the fixing post 131 is initially connected with the first electric connection slot 151. At this moment, the electric connection between the fixing post 131 and the backside plate 15 is established. Moreover, when the pushing element 132 is contacted with the first electric connection slot 151, it means that the fixing post 131 is completely connected with the first electric connection slot 151. Moreover, when the fixing post 131 is moved toward the main body 11 and the pushing element 132 is not contacted the first electric connection slot 151 but the fixing post 131 is still contacted with the first electric connection slot 151, it means that the fixing post 131 is initially detached from the first electric connection slot 151. Moreover, when the fixing post 131 is moved toward the main body 11 and the fixing post 131 is not contacted with the first electric connection slot 151, it means that the fixing post 131 is completely detached from the first electric connection slot 151.

Figure 10:
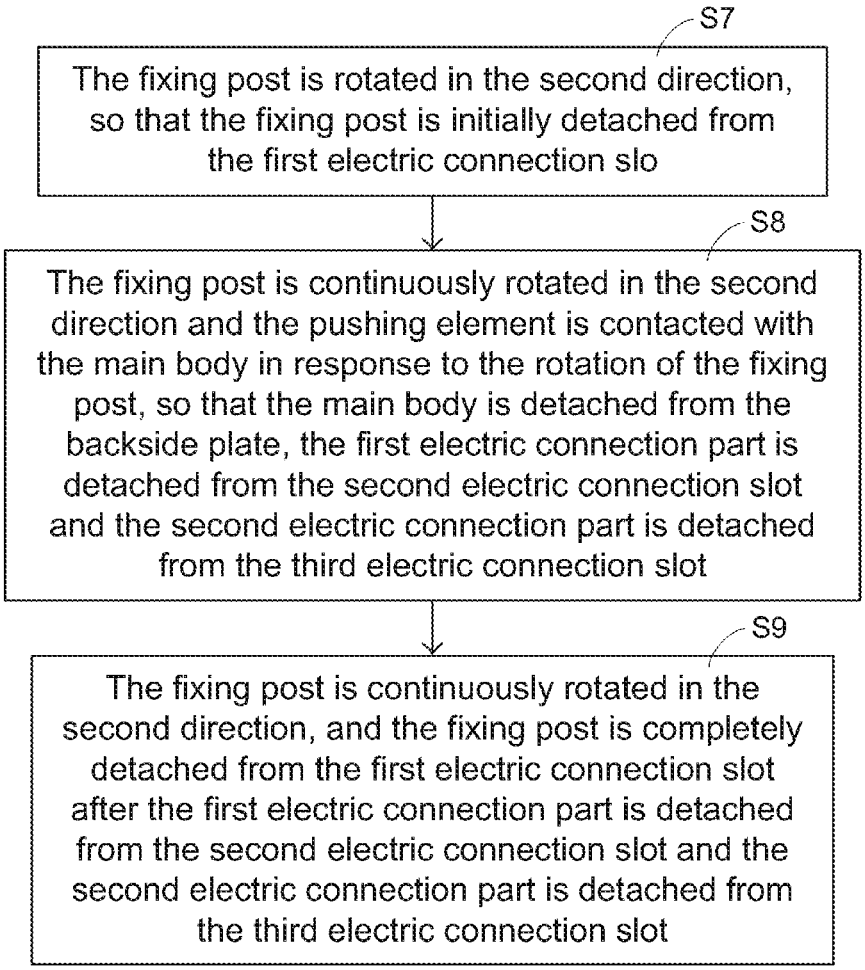
FIG. 10 is a flowchart illustrating a lighting device disassembling process complying with safety regulations according to an embodiment of the present invention.

A disassembling process of the lighting device will be illustrated as follows. FIG. 10 is a flowchart illustrating a lighting device disassembling process complying with safety regulations according to an embodiment of the present invention. The lighting device disassembling process comprises the following steps S7~S9.

In the step S7, the fixing post 131 is rotated in the second direction C2, so that the fixing post 131 is initially detached from the first electric connection slot 151. In the step S8, the fixing post 131 is continuously rotated in the second direction C2 and the pushing element 132 is contacted with the main body 11 in response to the rotation of the fixing post 131. Consequently, the main body 11 is detached from the backside plate 15, the first electric connection part 143 is detached from the second electric connection slot 152, and the second electric connection part 144 is detached from the third electric connection slot 153. In the step S9, the fixing post 131 is continuously rotated in the second direction C2, and the fixing post 131 is completely detached from the first electric connection slot 151 after the first electric connection part 143 is detached from the second electric connection slot 152 and the second electric connection part 144 is detached from the third electric connection slot 153.

Figure 11:
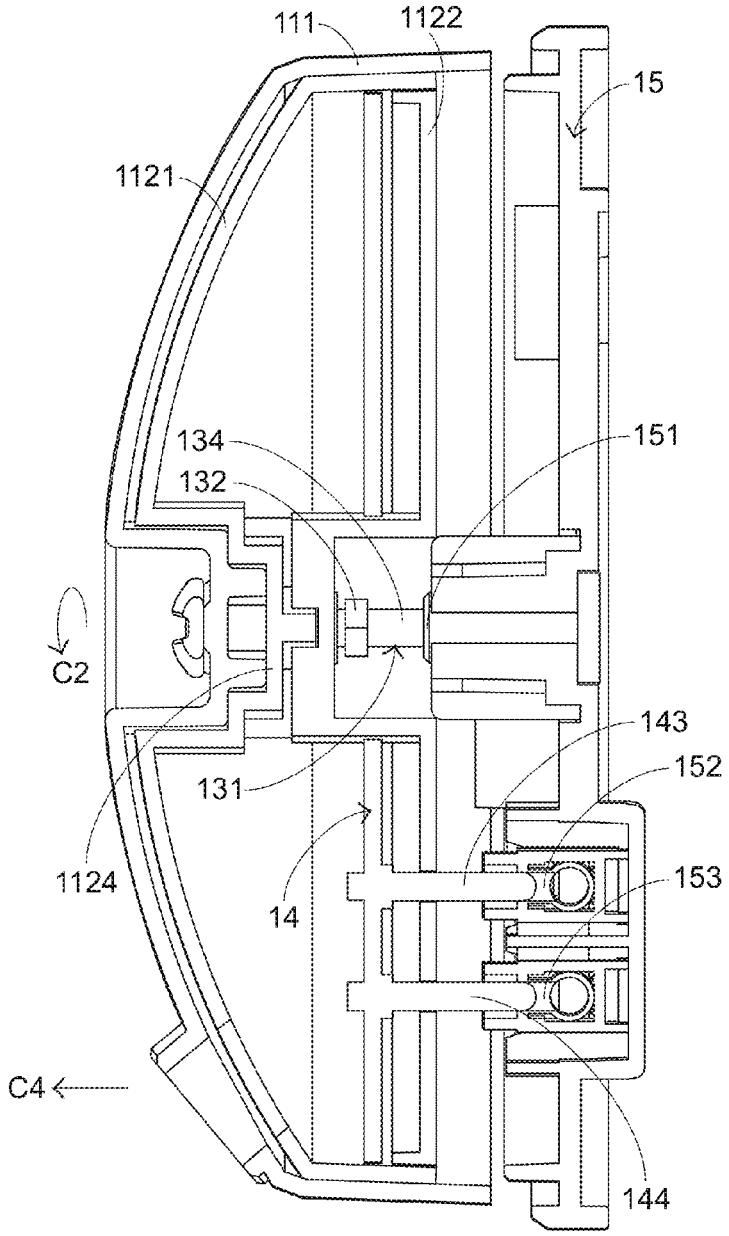
FIG. 11 is a schematic partial cross-sectional side view illustrating the initial detachment of the fixing module from the first electric connection slot in the lighting device disassembling process according to an embodiment of the present invention.
Figure 12:
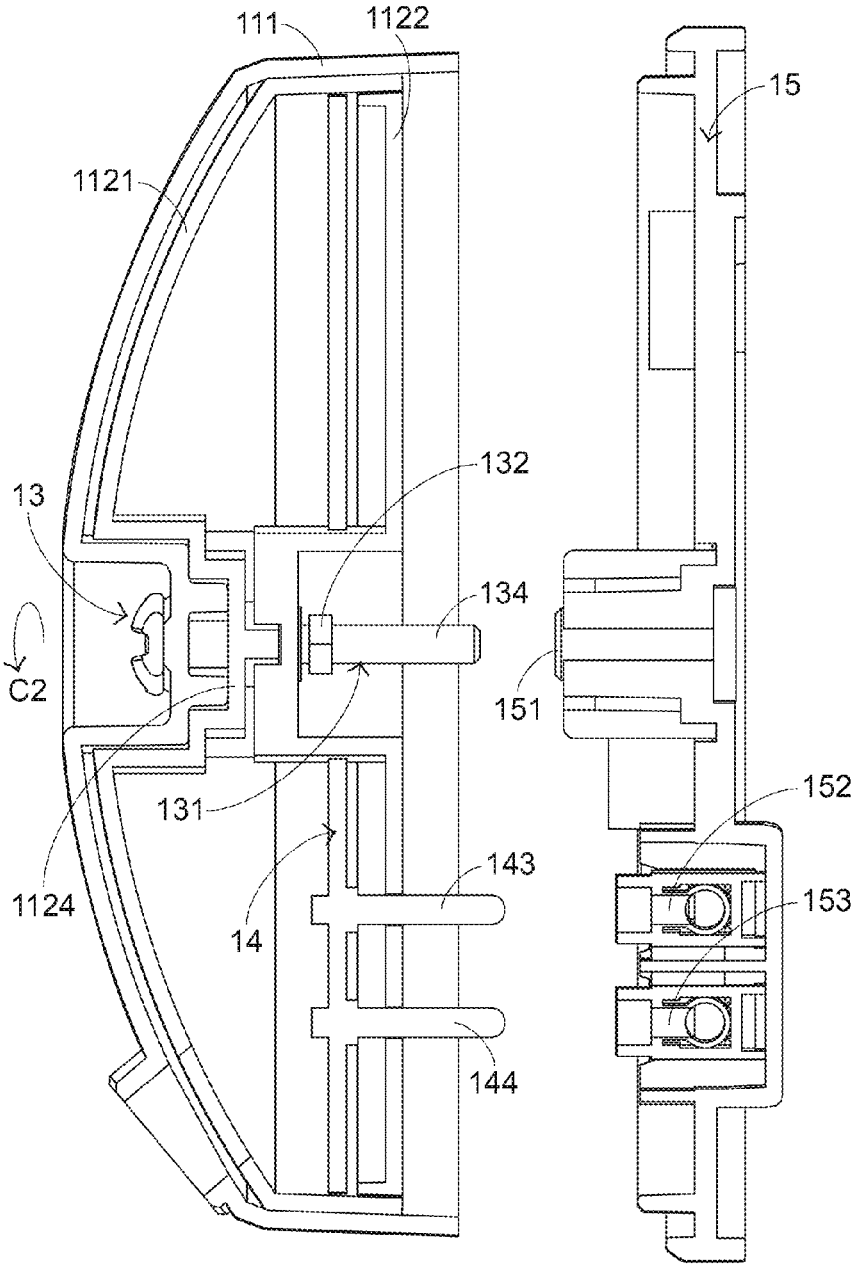
FIG. 12 is a schematic partial cross-sectional side view illustrating the complete detachment of the fixing module from the first electric connection slot in the lighting device disassembling process according to an embodiment of the present invention.

In the step S7, while the fixing post 131 is rotated in the second direction C2, the pushing element 132 fixed on the fixing post 131 is moved in the fourth direction C4 to push the first covering part 1121 in the fourth direction C4. Moreover, since second covering part 1122 is fixed on the first covering part 1121, the second covering part 1122 and the circuit module 14 within the accommodation space 113 are moved with the first covering part 1121 in the fourth direction. Meanwhile, the fixing post 131 is initially detached from the first electric connection slot 151. However, the fixing post 131 is still electrically connected with the first electric connection slot 151, the first electric connection part 143 is still electrically connected with the second electric connection slot 152, and the second electric connection part 144 is still electrically connected with the third electric connection slot 153 (see FIG. 11). After the step S8 is performed, the first electric connection part 143 and the second electric connection part 144 are detached from the second electric connection slot 152 and the third electric connection slot 153, respectively. Then, the fixing post 131 is completely detached from the first electric connection slot 151 (see FIG. 12). From the above discussions, after the live wire and the neutral wire are electrically disconnected from the power source, the earth wire is electrically disconnected from the power source. Consequently, the disassembling process of the lighting device 1 can comply with safety regulations.

In the above embodiment, the step S6 is performed after the first case 111 and the backside plate 15 are combined together. It is noted that numerous modifications and alterations may be made while retaining the teachings of the invention. For example, in another embodiment, the lamp and the human sensing module are installed on the main body before the first case and the backside plate are combined together.

From the above descriptions, the present invention provides the lighting device. Through the fixing module, the main body is installed on the backside plate. While the fixing module is connected with the backside plate, the earth wire is firstly electrically connected with the power source. Then, during the process of assembling the fixing module with the backside plate, the live wire (or the neutral wire) of the circuit module is electrically connected with the power source. After the live wire (or the neutral wire) of the circuit module is electrically connected with the power source, the fixing module and the backside plate are completely combined with each other. In the disassembling process of the lighting device, the fixing module is initially disassembled from the backside plate while maintaining the electric connection between the fixing module and the backside plate. Moreover, while the electric connection between the fixing module and the backside plate is still established, the main body and the backside plate are structurally detached from each other, so that the live wire (or the neutral wire) of the circuit module is electrically disconnected from the power source. Then, the fixing module is disassembled from the backside plate, so that the main body and the backside plate are structurally detached from each other and the earth wire is electrically disconnected from the power source. By the structure of the lighting device of the present invention, the assembling process of the lighting device is simplified, and both of the assembling process and the disassembling process comply with safety regulations.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A lighting device, comprising:

a lamp emitting a light beam;

a main body connected with the lamp, and comprising a first opening and a receiving sleeve;

a circuit module disposed within the main body, and comprising a first electric connection part;

a fixing module partially penetrated through the first opening and disposed within the receiving sleeve, wherein the circuit module is fixed within main body by the fixing module; and a backside plate disposed therein:

a first electric connection slot corresponding to the fixing module and electrically connected with a power source, wherein when the backside plate is connected with the main body, and the fixing module is inserted into the first electric connection slot, an electric connection between the fixing module and the first electric connection slot is established; and a second electric connection slot corresponding to the first electric connection part and electrically connected with the power source, wherein when the backside plate is connected with the main body, and the first electric connection part is inserted into the second electric connection slot, an electric connection between the first electric connection part and the second electric connection slot is established;

wherein the fixing module comprises:

a fixing post penetrated through the first opening, and comprising:

a first segment inserted into the receiving sleeve and connected with the backside plate, wherein the first segment has a first diameter; and a second segment inserted into the receiving sleeve and having a second diameter, wherein the second diameter is larger than the first diameter;

a pushing element sheathed around the fixing post and disposed within the receiving sleeve, wherein the circuit module is fixed in the main body by the pushing element, wherein when the first segment is contacted with the backside plate, the fixing post is initially connected with the backside plate, so that the electric connection between the fixing post and the backside plate is established, wherein when the backside plate is contacted with the pushing element, the fixing post is completely connected with the backside plate, wherein when the fixing post is moved toward the main body and the pushing element is not contacted with the backside plate, the fixing post is initially detached from the backside plate, wherein when the fixing post is moved toward the main body and the fixing post is not contacted with the backside plate, the fixing post is completely detached from the backside plate; and a fixing glue arranged between the first segment and the second segment, wherein the pushing element is fixed between the first segment and the second segment via the fixing glue, so that the pushing element and the fixing post are synchronously rotated and moved with each other.

2. The lighting device according to claim 1, wherein during a process of assembling the main body with the backside plate, the fixing module is initially connected with the first electric connection slot, so that the electric connection between the fixing module and the first electric connection slot is established, wherein after the first electric connection part is connected with the second electric connection slot, the fixing module is completely connected with the first electric connection slot, wherein during a process of disassembling the main body from the backside plate, the fixing module is initially detached from the first electric connection slot, wherein after the first electric connection part is detached from the second electric connection slot, the fixing module is completely detached from the first electric connection slot.

3. The lighting device according to claim 2, wherein the circuit module further comprises a second electric connection part, the second electric connection part is located beside the first electric connection part, the backside plate further comprises a third electric connection slot corresponding to the second electric connection part, and the third electric connection slot is electrically connected with the power source, wherein when the second electric connection part is inserted into the third electric connection slot, an electric connection between the second electric connection part and the third electric connection slot is established, wherein the fixing module is an earth wire, the first electric connection part is a live wire, and the second electric connection part is a neutral wire; and wherein during a process of assembling the main body with the backside plate, the fixing module is initially connected with the first electric connection slot, so that the electric connection between the fixing module and the first electric connection slot is established, wherein after the first electric connection part and the second electric connection part are connected with the second electric connection slot and the third electric connection slot, respectively, the fixing module is completely connected with the first electric connection slot, wherein during a process of disassembling the main body from the backside plate, the fixing module is initially detached from the first electric connection slot, wherein after the first electric connection part and the second electric connection part are detached from the second electric connection slot and the third electric connection slot, respectively, the fixing module is completely detached from the first electric connection slot.

4. The lighting device according to claim 2, wherein the fixing post further comprises:

a locking part located at a first end of the fixing post, wherein the locking part is stopped by the main body, so that the locking part is not inserted into the first opening;

wherein the second segment is arranged between the locking part and the first segment.

5. The lighting device according to claim 4, wherein when the fixing post is moved toward the main body, the main body is pushed by the pushing element, so that the first electric connection part of the circuit module within the main body is detached from the backside plate.

6. The lighting device according to claim 4, wherein the locking part, the first segment and the second segment are integrally formed with the fixing post, the fixing post is a screw, the first segment has plural threads distributed over a surface of the first segment, and the pushing element is a nut.

7. The lighting device according to claim 1, wherein the main body further comprises:

a first case, wherein the first opening runs through a first surface and a second surface of the first case;

a second case connected with the first case, and comprising:

a first covering part connected with the first case and contacted with the second surface of the first case, wherein the first covering part comprises a second opening, and the second opening runs through a first surface and a second surface of the first covering part, wherein the receiving sleeve is disposed on the second surface of the first covering part, and the receiving sleeve is arranged around the second opening; and a second covering part connected with the first case and fixed on the first covering part, wherein the second covering part comprises a third opening, and the third opening runs through a first surface and a second surface of the second covering part, wherein an accommodation space is defined by the first covering part and the second covering part collaboratively, and the circuit module is accommodated within the accommodation space, wherein the first case is made of a metallic material and the second case is made of a plastic material, or the first covering part is integrally formed with the first case.

8. The lighting device according to claim 7, wherein the second covering part further comprises a fourth opening, and the fourth opening is located beside the third opening, wherein the circuit module comprises a circuit board and plural electronic components, wherein the circuit board comprises a circuit board perforation, and the receiving sleeve is penetrated through the circuit board perforation and the third opening, wherein the plural electronic components are disposed on a first surface of the circuit board, and the first electric connection part is disposed on a second surface of the circuit board and penetrated through the fourth opening to be electrically connected with the second electric connection slot; or wherein the fixing module is an earth wire and the first electric connection part is a live wire.

9. The lighting device according to claim 1, wherein the lighting device further comprises a human sensing module, and the human sensing module detects whether any human body is located within a sensing range, wherein if the human sensing module detects that a human body is within the sensing range, the human sensing module issues a human sensing signal, wherein a warning function or an automatic illuminating function is enabled in response to the human sensing signal, wherein the human sensing module comprises a sensor body and a human sensor, wherein the sensor body is connected with the main body, and the human sensor is disposed within the sensor body and detects whether any human body is located within a sensing range, wherein if the human sensor detects that a human body is within the sensing range, the human sensor generates the human sensing signal in order to provide the warning function or the automatic illuminating function, wherein the human sensor comprises at least one of a passive infrared sensor and a microwave sensor; or wherein the lamp comprises a lamp body and a light-emitting element, wherein the lamp body is connected with the main body, and the light-emitting element is disposed within the lamp body and emits the light beam, wherein the lighting device is an outdoor lighting device, and the light-emitting element comprises at least one light emitting diode unit.

10. A lighting device assembling and disassembling method complying with safety regulations, the lighting device assembling and disassembling method comprising steps of:

(1) an assembling process of a lighting device, comprising steps of:

allowing a fixing post to be penetrated through a main body from a first side of the main body, and allowing a pushing element to be disposed on the fixing post from a second side of the main body;

installing and fixing a circuit module within the main body;

rotating the fixing post in a first direction, so that the fixing post is initially connected with a first electric connection slot of a backside plate;

continuously rotating the fixing post in the first direction, and allowing a first electric connection part of the circuit module to be connected with a second electric connection slot of the backside plate; and continuously rotating the fixing post in the first direction, and allowing the fixing post to be completely connected with the first electric connection slot after the first electric connection part is connected with the second electric connection slot; and (2) a disassembling process of the lighting device, comprising steps of:

rotating the fixing post in a second direction, so that the fixing post is initially detached from the first electric connection slot, wherein the second direction is reverse to the first direction;

continuously rotating the fixing post in the second direction and allowing the pushing element to be contacted with the main body in response to rotation of the fixing post, so that the main body is detached from the backside plate, wherein when the main body is detached from the backside plate, the first electric connection part is detached from the second electric connection slot; and continuously rotating the fixing post in the second direction, and allowing the fixing post to be completely detached from the first electric connection slot after the first electric connection part is detached from the second electric connection slot wherein the step of allowing the pushing element to be disposed on the fixing post from the second side of the main body comprises sub-steps of:

allowing a first case of the main body and a first covering part of the main body to be connected with each other;

allowing the fixing post to be penetrated through the first case and the first covering part from the first side of the main body;

allowing the pushing element to be disposed on the fixing post from a second side of the first covering part in a sheathing manner, a spot-welding manner or a snap-fitting manner;

rotating the pushing element in the second direction and fixing the pushing element on the fixing post, so that the pushing element is synchronously rotated and moved with the fixing post.

11. The lighting device assembling and disassembling method according to claim 10, wherein the step of installing and fixing the circuit module within the main body comprises sub-steps of:

allowing the circuit module to be disposed within the first covering part from the second side of the first covering part, and allowing the fixing element and the pushing element to be penetrated through the circuit module;

allowing the first covering part and a second covering part of the main body to be connected with each other; and fixing the second covering part on the first covering part from the second side of the first covering part, and fixing the circuit module within the first covering part and the second covering part.

12. The lighting device assembling and disassembling method according to claim 10, wherein when the fixing post is rotated in the first direction, the fixing post is moved in a direction toward the second side of the main body and the main body is pushed by the fixing post to be close to the backside plate, wherein when the fixing post is rotated in the second direction, the fixing post is moved in a direction toward the first side of the main body and the main body is pushed by the pushing element to be moved away from the backside plate; or wherein when the fixing post is rotated to be moved and the first electric connection part is connected with the second electric connection slot, a second electric connection part of the circuit module is connected with a third electric connection slot of the backside plate, wherein when the fixing post is rotated and the main body is pushed by the pushing element, the first electric connection part is detached from the second electric connection slot and the second electric connection part is detached from the third electric connection slot.

13. A lighting device assembling and disassembling method complying with safety regulations, the lighting device assembling and disassembling method comprising steps of:

allowing a first case of the main body and a first covering part of the main body to be connected with each other;

allowing the fixing post to be penetrated through the first case and the first covering part from the first side of the main body;

allowing the pushing element to be disposed on the fixing post from a second side of the first covering part in a sheathing manner, a spot-welding manner or a snap-fitting manner;

rotating the pushing element in the second direction and fixing the pushing element on the fixing post, so that the pushing element is synchronously rotated and moved with the fixing post, wherein the step of allowing the pushing element to be disposed on the fixing post from the second side of the main body comprises sub-steps of:

allowing a first case of the main body and a first covering part of the main body to be connected with each other;

allowing the fixing post to be penetrated through the first case and the first covering part from the first side of the main body;

allowing the pushing element to be sheathed around the fixing post from a second side of the first covering part;

rotating the pushing element in the second direction and fixing the pushing element on the fixing post; and attaching a fixing glue between the fixing post and the pushing element, wherein the pushing element is fixed on the fixing post via the fixing glue, so that the pushing element is synchronously rotated and moved with the fixing post.

14. The lighting device assembling and disassembling method according to claim 13, wherein the step of installing and fixing the circuit module within the main body comprises sub-steps of:

allowing the circuit module to be disposed within the first covering part from the second side of the first covering part, and allowing the fixing element and the pushing element to be penetrated through the circuit module; and fixing a second covering part of the main body on the first covering part from the second side of the first covering part, and fixing the circuit module within the first covering part and the second covering part.

15. The lighting device assembling and disassembling method according to claim 13, wherein when the fixing post is rotated in the first direction, the fixing post is moved in a direction toward the second side of the main body and the main body is pushed by the fixing post to be close to the backside plate, wherein when the fixing post is rotated in the second direction, the fixing post is moved in a direction toward the first side of the main body and the main body is pushed by the pushing element to be moved away from the backside plate; or wherein when the fixing post is rotated to be moved and the first electric connection part is connected with the second electric connection slot, a second electric connection part of the circuit module is connected with a third electric connection slot of the backside plate, wherein when the fixing post is rotated and the main body is pushed by the pushing element, the first electric connection part is detached from the second electric connection slot and the second electric connection part is detached from the third electric connection slot.

16. A lighting device, comprising:

a lamp emitting a light beam;

a main body connected with the lamp, and comprising a first opening and a receiving sleeve;

a circuit module disposed within the main body, and comprising a first electric connection part;

a fixing module partially penetrated through the first opening and disposed within the receiving sleeve, wherein the circuit module is fixed within main body by the fixing module; and a backside plate disposed therein:

a first electric connection slot corresponding to the fixing module and electrically connected with a power source, wherein when the backside plate is connected with the main body, and the fixing module is inserted into the first electric connection slot, an electric connection between the fixing module and the first electric connection slot is established; and a second electric connection slot corresponding to the first electric connection part and electrically connected with the power source, wherein when the backside plate is connected with the main body, and the first electric connection part is inserted into the second electric connection slot, an electric connection between the first electric connection part and the second electric connection slot is established;

wherein the main body further comprises:

a first case, wherein the first opening runs through a first surface and a second surface of the first case;

a second case connected with the first case, and comprising:

a first covering part connected with the first case and contacted with the second surface of the first case, wherein the first covering part comprises a second opening, and the second opening runs through a first surface and a second surface of the first covering part, wherein the receiving sleeve is disposed on the second surface of the first covering part, and the receiving sleeve is arranged around the second opening; and a second covering part connected with the first case and fixed on the first covering part, wherein the second covering part comprises a third opening, and the third opening runs through a first surface and a second surface of the second covering part, wherein an accommodation space is defined by the first covering part and the second covering part collaboratively, and the circuit module is accommodated within the accommodation space, wherein the first case is made of a metallic material and the second case is made of a plastic material, or the first covering part is integrally formed with the first case.

17. The lighting device according to claim 16, wherein the second covering part further comprises a fourth opening, and the fourth opening is located beside the third opening, wherein the circuit module comprises a circuit board and plural electronic components, wherein the circuit board comprises a circuit board perforation, and the receiving sleeve is penetrated through the circuit board perforation and the third opening, wherein the plural electronic components are disposed on a first surface of the circuit board, and the first electric connection part is disposed on a second surface of the circuit board and penetrated through the fourth opening to be electrically connected with the second electric connection slot; or wherein the fixing module is an earth wire and the first electric connection part is a live wire.

* * * * *